US006550538B1

(12) United States Patent
Herrmann et al.

(10) Patent No.: US 6,550,538 B1
(45) Date of Patent: Apr. 22, 2003

(54) COMMUNICATION WITH A DOWNHOLE TOOL

(75) Inventors: Wolfgang E. J. Herrmann, Valle Arriba (VE); Kenneth R. Goodman, Cypress, TX (US); Vladimir Vaynshteyn, Sugar Land, TX (US); Merlin D. Hansen, Missouri City, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 118 days.

(21) Appl. No.: 09/717,979

(22) Filed: Nov. 21, 2000

(51) Int. Cl.[7] ..... E21B 43/00

(52) U.S. Cl. ..... 166/373; 166/250.01; 166/66; 340/853.3

(58) Field of Search ..... 166/373, 250.01, 166/374, 66; 340/853.3, 854.4, 853.9, 853.1

(56) References Cited

U.S. PATENT DOCUMENTS

| | | | | |
|---|---|---|---|---|
| 3,254,531 A | | 6/1966 | Briggs, Jr. | |
| 3,665,955 A | | 5/1972 | Conner, Sr. | |
| 3,971,317 A | | 7/1976 | Gemmell et al. | |
| 4,078,620 A | | 3/1978 | Westlake et al. | |
| 4,489,786 A | | 12/1984 | Beck | |
| 4,553,589 A | | 11/1985 | Jennings et al. | |
| 4,632,034 A | | 12/1986 | Colle, Jr. | |
| 4,635,717 A | | 1/1987 | Jageler | |
| 4,712,613 A | | 12/1987 | Nieuwstad | |
| 4,856,595 A | | 8/1989 | Upchurch | |
| 4,896,722 A | | 1/1990 | Upchurch | |
| 4,915,168 A | | 4/1990 | Upchurch | |
| 4,953,618 A | | 9/1990 | Hamid et al. | |
| 4,971,160 A | | 11/1990 | Upchurch | |
| 5,056,600 A | | 10/1991 | Surjaatmadja et al. | |
| 5,515,336 A | | 5/1996 | Chin et al. | |
| 5,691,712 A | | 11/1997 | Meek et al. | |
| 5,963,138 A | | 10/1999 | Gruenhagen | |
| 5,965,031 A | * | 10/1999 | Kitz et al. | 166/310 |
| 6,173,772 B1 | | 1/2001 | Vaynshteyn | |
| 6,182,764 B1 | | 2/2001 | Vaynshteyn | |
| 6,384,738 B1 | * | 5/2002 | Carstensen et al. | 340/853.1 |

FOREIGN PATENT DOCUMENTS

| | | |
|---|---|---|
| EP | 0 344 060 | 11/1989 |
| EP | 0 456 415 | 11/1991 |
| EP | 0 604 134 | 6/1994 |

* cited by examiner

*Primary Examiner*—Thomas B. Will
*Assistant Examiner*—Jennifer Dougherty
(74) *Attorney, Agent, or Firm*—Trop Pruner & Hu PC; Jaime A. Castaño; Jeffrey E. Griffin

(57) ABSTRACT

A system that is usable with a subterranean well includes a downhole assembly and an apparatus. The downhole assembly is adapted to respond to a command that is encoded in a stimulus that is communicated downhole. The apparatus is adapted to change a pressure of a gas in communication with the well to generate the stimulus.

69 Claims, 6 Drawing Sheets

COMMUNICATION WITH A DOWNHOLE TOOL

BACKGROUND

The invention generally relates to communicating with a downhole tool.

A perforating gun may be used to form tunnels in a subterranean formation for purposes of enhancing production from the formation. To accomplish this, the perforating gun typically has shaped charges that fire in response to a detonation wave propagating along a detonating cord. In this manner, the perforating gun may be lowered downhole via a tubular string (for example) until the perforating gun is at a desired depth. Some action is then taken to cause a downhole firing head to initiate the detonation wave to fire the perforating gun.

For example, one technique to cause the firing head to initiate the detonation wave involves communicating with the firing head via pressure changes that propagate through a hydrostatic column of liquid that extends from a region near the firing head to the surface of the well. In this manner, the firing head may be electrically coupled to a pressure sensor or strain gauge to detect changes in a pressure of the column of liquid near the firing head. Thus, due to this arrangement, pressure may be selectively applied to the column of liquid at the surface of the well to encode a command (a fire command, for example) for the firing head, and the resulting pressure changes that are introduced to the liquid at the surface of the well propagate downhole to the sensor. The firing head may then decode the command and take the appropriate action.

However, the above-described technique is used when the column of liquid extends to the surface of the well. The liquid may extend to the surface in overbalanced or underbalanced wells. In this manner, in overbalanced wells, the column of liquid ensures that the pressure that is exerted by the hydrostatic column of liquid near the region of perforation overcomes the pressure that is exerted by the formation once perforation occurs. The column may or may not extend to the surface of the well to establish this condition. In contrast to an overbalanced well, an underbalanced well is created to maximize the inflow of well fluid from the formation by creating, as its name implies, an underbalanced condition in which the formation pressure overcomes the pressure that is established by the column of hydrostatic liquid. The hydrostatic liquid for an underbalanced well may or may not extend to the surface of the well.

Therefore, for both underbalanced and overbalanced wells, the column of hydrostatic fluid may not extend to the surface of the well. For these cases, because the liquid does not extend to the surface of the well, the above-described technique of communicating by selectively applying pressure to the liquid at the surface of the well may not be used.

Therefore, conventionally other techniques are used to communicate commands to the firing head in an underbalanced well. For example, the firing head may respond to a bar that is dropped from the surface of the well. In this manner, the bar strikes the firing head to initiate a detonation wave on the detonating cord. It is noted that this technique may not be used in horizontal wells.

Another technique to communicate with the firing head involves the use of an expensive and complex pump system at the surface of the well to completely fill the central passageway of the string with a gas (Nitrogen, for example) to the point that the pressure is sufficient to activate the firing head. The pressurization is necessary to overcome a mechanical barrier that is associated with the firing head. For example, the pressure in the string may be increased until it reaches an absolute pressure and breaks the mechanical barrier. As an example, this mechanical barrier may be established by a shear pin that shears when the predetermined pressure differential threshold is overcome. Once the mechanical barrier is overcome, the firing head fires the perforating gun. For purposes of establishing a safety margin, the pressure differential typically must substantially exceed the nominal manufacturer-specified threshold of the mechanical barrier. Therefore, the pump system at the surface of the well must supply a large volume of gas downhole to fill the string and establish the required pressure.

The same difficulties exist in communicating with downhole tools (packers, for example) other than firing heads in an underbalanced well. Thus, there is a continuing need for an arrangement to address one or more of the problems that are stated above.

SUMMARY

In an embodiment of the invention, a system that is usable with a subterranean well includes a downhole assembly and an apparatus. The downhole assembly is adapted to respond to a command that is encoded in a stimulus that is communicated downhole. The apparatus is adapted to change a pressure of a gas in communication with the well to generate the stimulus.

In another embodiment of the invention, a method that is usable with a subterranean well includes establishing a gas layer above a downhole assembly and selectively pressurizing the gas layer to generate a stimulus to propagate through the gas layer to the downhole assembly. The pressurization of the gas layer is controlled to encode a command for the downhole assembly in the stimulus.

In yet another embodiment of the invention, a method that is usable with a subterranean well includes receiving a stimulus downhole. The stimulus has a first pressure signature, and the first pressure signature is compared to a second pressure signature to determine an error between the first and second pressure signatures. The method includes determining whether the first pressure signature indicates a command based on the error.

Advantages and other features of the invention will become apparent from the following description, drawing and claims.

DETAILED DESCRIPTION

Figure 1:
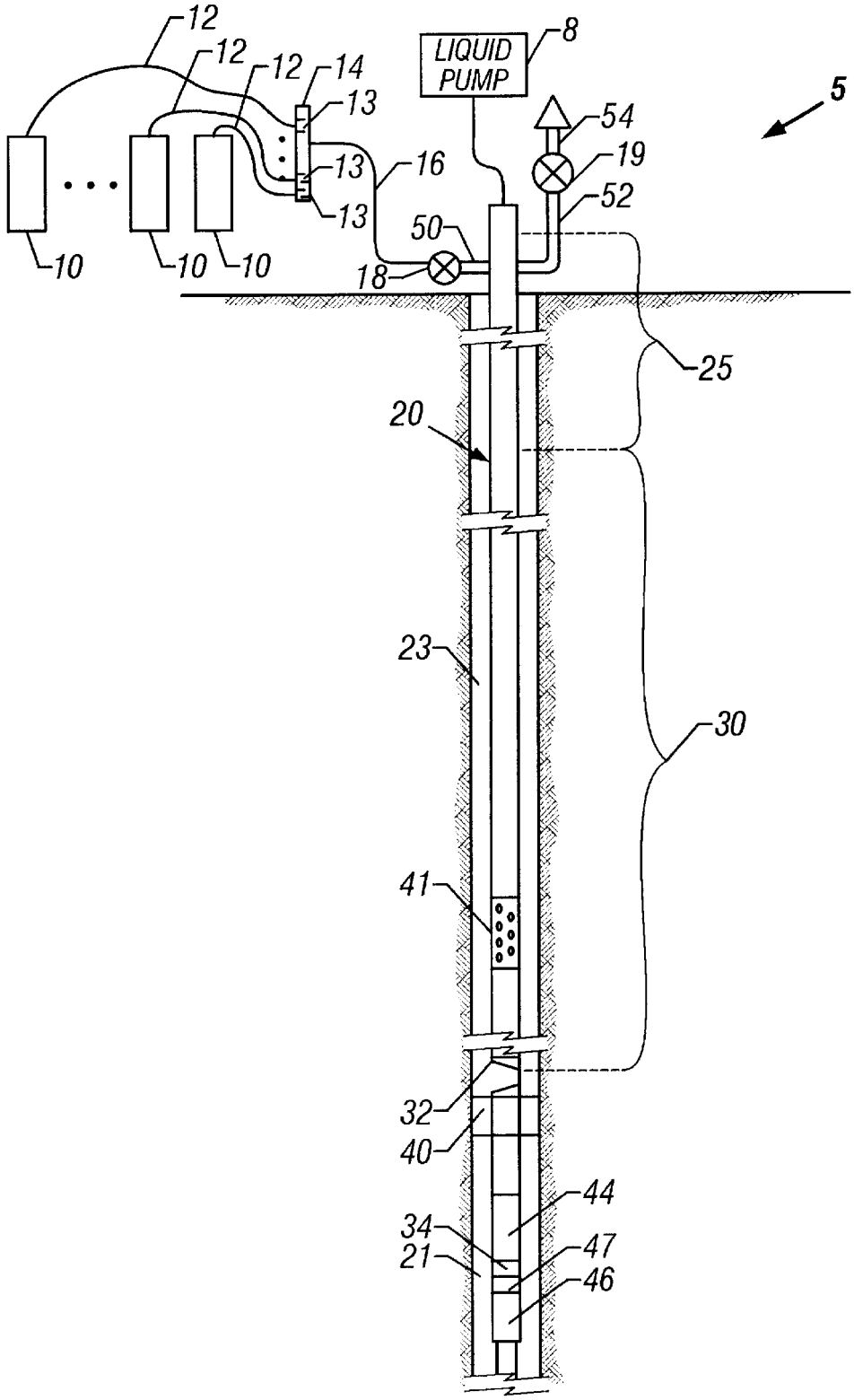
FIG. 1 is schematic diagram of a subterranean well according to an embodiment of the invention.

Referring to FIG. 1, an embodiment 5 of a system for a subterranean well includes a tubular string 20 that extends from a surface of the well downhole for purposes of performing perforating and/or testing operations (as examples) in the well. For example, the string 20 may include a perforating gun 46 that is used to form perforation tunnels in the formation(s) that surround the perforating gun 46. In this manner, as described herein, a stimulus (a stimulus that encodes a fire command, for example) may be communicated downhole to a downhole assembly (an assembly that includes a firing head 47, a pressure sensor 34 and a perforating gun 46, as an example) to send a command to the downhole assembly. For example, the command may be a firing command to instruct the firing head 47 to fire the perforating gun 46.

Figure 2:
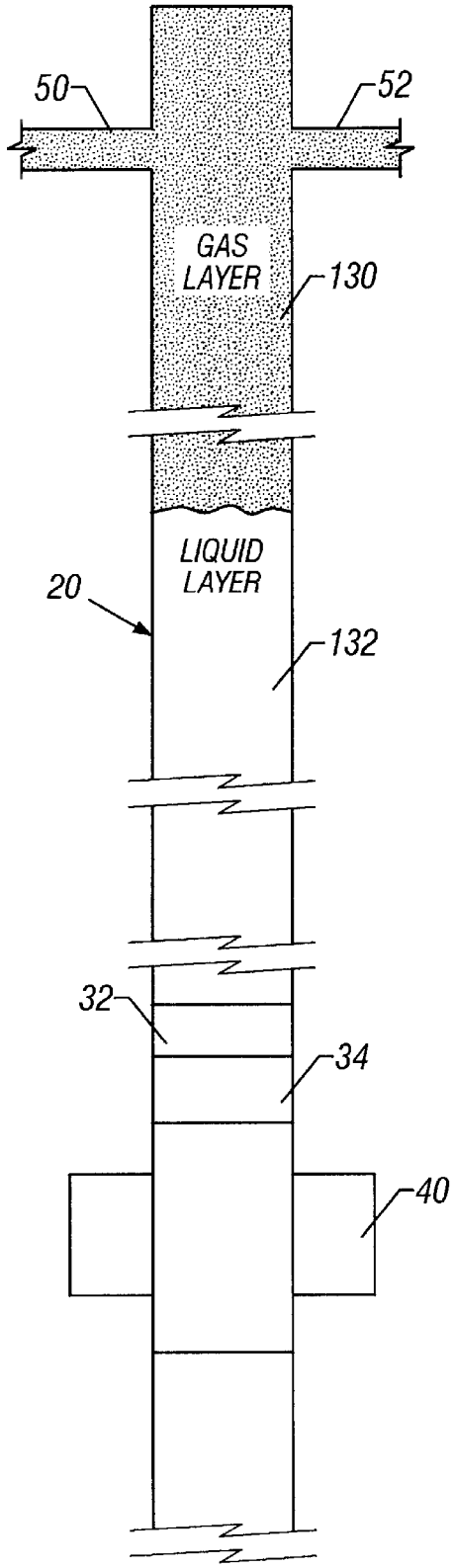
FIG. 2 is a schematic diagram of the well depicting the gas and liquid layers present in the well according to an embodiment of the invention.

In some embodiments of the invention, the well may be underbalanced to enhance the inflow of well fluid from the formation after perforation occurs. However; a possible constraint of underbalanced perforating is that the hydrostatic column of liquid that stands in the central passageway of the tubing 20 prior to perforation must establish downhole pressure that is less than the pressure that is exerted by the formation once perforation occurs. Referring to FIG. 2, as result of this constraint, in some embodiments of the invention, the central passsageway of the tubing 20 contains two layers: a lower liquid layer 132 that does not reach the surface of the well and an upper gas layer 130 that extends from the liquid layer 132 to the surface of the well. It is noted that the liquid 132 and gas 130 layers may also be present in an overbalanced well, and the techniques and arrangements described herein also apply to overbalanced wells.

Even though the liquid layer 132 does not extend to the surface of the well, for purposes of communicating commands downhole (to a downhole tool, such as the firing head 47), the system 5 forms pressure pulses in the gas layer 130. These pressure pulses propagate through the liquid layer 132 to a downhole pressure sensor 34 that detects the pulses. As described below, a downhole tool, such as the firing head 47, may be coupled to the pressure sensor to extract and respond to a command from these pressure pulses. As other examples, the downhole tool may include valve, a mechanical assembly or an electrical assembly that is responsive to respond to a command from the pressure pulses.

Alternatively, in some embodiments of the invention, the central passageway of the tubing 20 may not include any liquid, but may instead be filled entirely with gas. Also, in some embodiments of the invention, the well may be placed in an overbalanced condition without the liquid extending to the surface of the well.

Referring back to FIG. 1, as an example, the gas 130 and liquid 132 (see FIG. 2) layers may be formed in the following manner. A ball valve 32 that controls communication through a packer 40 of the string 20 may be left opened while the string 20 is run downhole to a certain depth, a depth that establishes the desired level of liquid in the central passageway of the string 20. After reaching this depth, the ball valve 32 is closed, and the string 20 is run downhole until the perforating gun 46 is placed at the appropriate position. Alternatively, the string 20 may be run downhole with the ball valve 32 closed. After the string 20 has been run downhole, a liquid pump 8 at the surface of the well may then be used to introduce liquid into the central passageway of the tubular string 20.

In some embodiments of the invention, to achieve an underbalanced condition, the liquid in the central passageway of the tubing 20 and in the annulus of the well does not extend to the surface of the well, as the weight of this liquid controls the pressure downhole. As a result, the string 20 may be divided into two parts: a lower part 30 that contains the layer 132 of liquid (see also FIG. 2) and an upper part 25 that contains the layer 130 of gas (see also FIG. 2). A similar division of liquid and gas may exist in the annulus 23. It is noted that the gas be, as an example, air at atmospheric or another pressure. Alternatively, the gas may be Nitrogen, as another example. Other gases may be used.

Therefore, conventional techniques may not be used to communicate stimuli through the liquid in the annulus of the well or the liquid in the central passageway of the tubular string 20 for purposes of encoding commands to actuate downhole tools of the tubular string 20. However, unlike these conventional arrangements, the system 5 includes containers 10 (bottles, for example) of gas that are located at the surface of the well and are used to generate pressure pulses in the gas layer 130. These pressure pulses, in turn, propagate downhole to the pressure sensor 34. As examples, the gas in the containers 10 may be an inert gas, such as Nitrogen gas, and may even be air, for example, that is held under pressure inside the containers 10. As an example, each container 10 may have a capacity of about 305 standard cubic feet (scf), although other sized containers and thus, other capacities are possible.

In the context of this application, the term "liquid" may refer to a liquid of a primary composition and may also refer to a mixture of such liquids. The liquid layer may include dissolved gas but is primarily formed from liquid. The term "gas" may refer to a gas of a primary composition and may also refer to a mixture of such gases. The gas layer may include condensed liquid but is primarily formed from gas.

In some embodiments of the invention, each container 10 has an output nozzle that is connected via an associated hose 12 to a different inlet port of a gas manifold. 14. The inlet ports of the manifold 14 may include check valves 13 to prevent backflow of gas or well fluids into the containers 10. These check valves 13, in some embodiments of the invention, include flow restrictors to regulate the flow of gas out of the gas manifold 14. The flow restrictors and the check valves 13 may either be separate devices or combined into one apparatus, depending on the particular embodiment of the invention. An outlet port 50 of the manifold 14 is connected to a hose 16 that extends to the inlet port of a valve 18 that controls when the gas layer 130 is pressurized, as the outlet port of the valve 18 is in communication with the central passageway of the tubular string 20. It is noted that the outlet nozzles of the containers 10 are left open, as communication between the containers 10 and the central passageway of the tubular string 20 is controlled by the valve 18. Another conduit 52 establishes communication between an inlet port of a valve 19 that controls communication between the central passageway of the tubular string 20 and a vent 54.

Due to this arrangement, a pressure pulse that encodes all or part of a command for a downhole tool may be communicated downhole in the following manner. First, the valve 18 is opened to dump gas from the containers 10 into the central passageway of the tubular string 10 to introduce an increase in the pressure in the gas layer 130, as the volume of the gas layer 130 does not substantially change. This increase in pressure forms the beginning of a pressure pulse and propagates through the gas 130 (FIG. 2) and liquid 132 (FIG. 2) layers to the pressure sensor 34. After a predetermined amount of time, the valve 18 is then closed and the valve 19 is opened to vent pressure from the gas layer 130 to form the end of the pressure pulse. In this manner, this venting produces a pressure drop that propagates downhole through the liquid layer 132 to the sensor 34. The opening and closing of the valves 18 and 19 may be done manually, automatically (via computer-controlled valves, for example), or may be accomplished via a combination of manual and automatic control.

It is noted that each pressure pulse that is generated using the gas containers 10 may be relatively small (35 pounds per square inch (p.s.i.), for example), as compared to the total pressure (5000 p.s.i., for example) that typically is present at the sensor 34 due to the weight of the liquid layer 132. The minimum number of bottles that are required to generate a 35 p.s.i. pulse (as an example) may be given by the following equation:

$$N = \frac{C \cdot 13.37}{B},$$

where "N" represents the number of gas containers 10 (rounded up), "C" represents the air volume (in barrels (bbls)) of the gas layer 130 and "B" is the bottle capacity in standard cubic feet (scf). Other amplitudes for the pressure pulses are possible. For example, in some embodiments of the invention, the amplitude of each pressure pulse may be near or less than 500 p.s.i and preferably near or less than 300 p.s.i.

It is possible, in some embodiments of the invention, that a gas layer does not exist in the central passageway of the string 20 or in the annulus. Instead, the gas layer may be formed entirely in the hose 16 that extends to the manifold 14.

Figure 3:
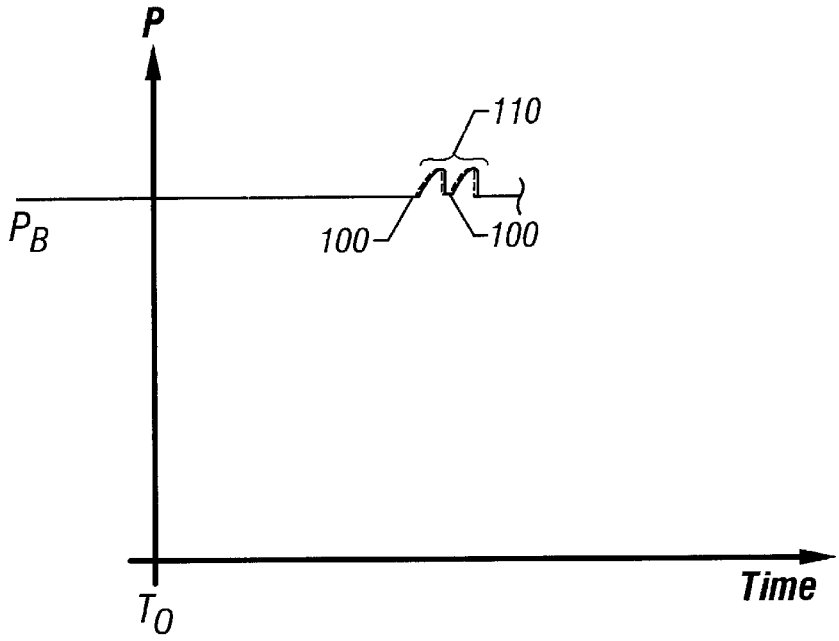
FIG. 3 is a plot of a pressure detected by a downhole pressure sensor of a tubular string of the well according to an embodiment of the invention.

In some embodiments of the invention, a command for a downhole tool (such as the firing head 47 or the packer 40, as examples) may be communicated downhole by a sequence of more than one pressure pulse. As an example, FIG. 3 depicts a waveform of a pressure (called P) that is detected by the downhole pressure sensor 34 beginning at a time $T_0$ after the liquid layer 132 is established. As shown, the pressure P has a pressure level $P_B$ at time $T_0$a pressure level that establishes a baseline pressure for pressure pulses 100 that are generated by the technique described herein.

A particular command may be represented by a sequence of more than one pressure pulse 100. For example, as depicted in FIG. 3, two successive pressure pulses 100 may appear in a sequence 110 that indicates a command for instructing the firing head 47 to fire the perforating gun 46, as an example.

It is noted that besides initiating the firing of a perforating gun, the pulses 100 may be used for other purposes, such as the communication of commands to set the packer 40, control operation of a chemical cutting tool, or operate a valve, as just a few examples.

Figure 4:
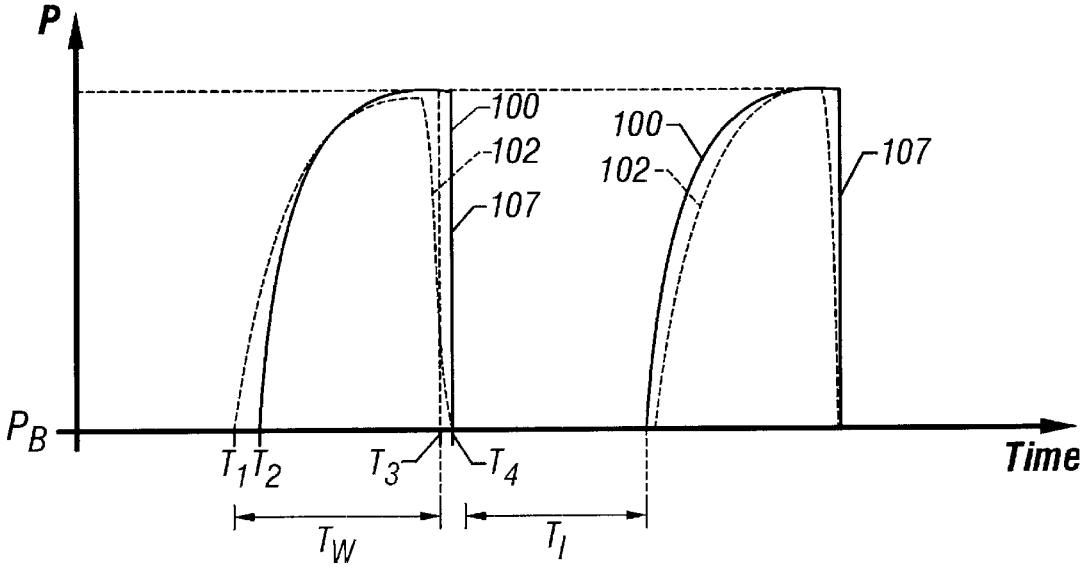
FIG. 4 is a more detailed plot of pressure pulses detected by the downhole pressure sensor according to an embodiment of the invention.

FIG. 4 depicts the signatures of exemplary pressure pulses 100 in more detail. In this manner, when the valve 18 is opened (and the valve 19 is closed), the dumping of the gas into the gas layer 130 increases the pressure of the gas layer 130 exponentially as long as the valve 18 remains open. Although the liquid layer 132 may introduce a propagation delay, this exponential rise in the pressure P is experienced by the sensor 34 beginning at time $T_2$ and extending until time $T_3$. The valve 18 is then closed and the valve 19 is opened to cause a pressure release that propagates to the sensor 34 at time $T_3$ and causes the pressure P increase to decrease until the pressure P reaches the baseline pressure $P_B$ at time $T_4$. Successive pulses 100 of the same signature 110 may be separated in time by a predetermined interval of time (called $T_i$).

Figure 5:
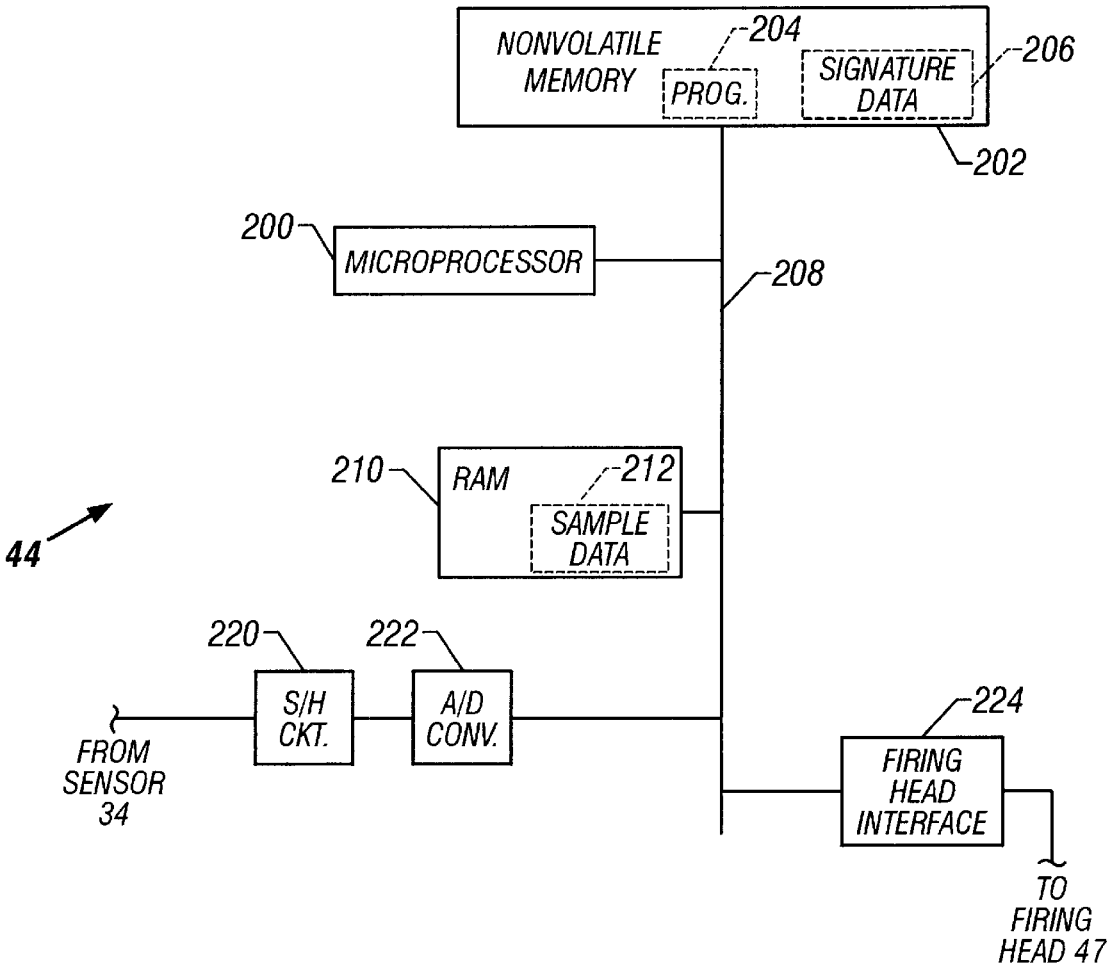
FIG. 5 is a schematic diagram of circuitry of the tubular string according to an embodiment of the invention.

Referring to FIG. 5, in some embodiments of the invention, the tubular string 20 may, include an electronics module 44 (see also FIG. 1) that may be associated with or part of the tool to be controlled (such as the firing head 47, for example) and is electrically coupled to the downhole pressure sensor 34. In some embodiments of the invention, the electronics module 44 includes a microprocessor 200 that is coupled via a bus 208 to a non-volatile memory 202 (a read only memory (ROM), for example) and a random access memory (RAM) 210. Also coupled to the bus 208 are an analog-to-digital (A/D) converter 222 and a firing head interface 224 (as an example). The non-volatile memory 202 stores instructions that form a program 204 that, when executed by the microprocessor 200, causes the microprocessor 200 to detect the pulses, 100 and recognize sequences of pulses that indicate commands. The non-volatile memory 202 may also store signature data 206 that indicates the appropriate signature for the pressure pulses 100 and is used by the microprocessor 200 to verify the detection of each pressure pulse 100, as described below.

The A/D converter 222 is coupled to a sample and hold (S/H) circuit 220 that receives an analog signal from the pressure sensor 34 indicative of the sensed pressure. The S/H circuit 220 samples the analog signal to provide a sampled signal to the A/D converter 222, and the A/D converter 222 converts the sampled signal into digital sampled data 212 that is stored in the RAM 210.

In some embodiments of the invention, the microprocessor 200 executes the program 204 to perform a routine 240 to detect the pressure pulses 100. In this manner, referring to FIG. 6, in the routine 240, the microprocessor 200 reviews (block 250) the latest sampled pressures (via the sampled data 212) to detect some characteristic of a potential pressure pulse 100, such as a falling, or trailing edge 107 (see FIG. 4) of a potential pressure pulse 100. For example, for 35 p.s.i. pressure pressure pulses, the microprocessor 200 reviews the sampled data 212 to detect a 15 p.s.i. (for example) drop in the detected pressures, a drop that may indicate the trailing edge 107. When the microprocessor 200 determines (diamond 252) that a trailing edge 107 of a potential pressure pulse may have been detected, the microprocessor 200 proceeds to block 254 of FIG. 6. Otherwise, the microprocessor 200 continues to review the latest sampled pressures.

When the microprocessor 200 detects a potential trailing edge 107, the microprocessor 200 determines differences between the sampled pressures (as indicated by the sampled data 212) and the ideal pressures that are indicated by the signature data 202 over a time interval called $T_W$ (see FIG. 4). Based on these differences, the microprocessor 200 determines (block 256) an amount of error, or an error fit, between the ideal and actual data based on these differences. Based on this error fit, the microprocessor 200 determines (diamond 258) whether a pressure pulse 100 has been detected, and if so, sets (block 260) a flag indicating the detection of a pressure pulse. Otherwise, it is deemed that a pressure pulse has not been detected, and the microprocessor 200 returns to block 250.

As an example, the downhole pressure sensor 34 may detect the pulse 100 that rises upwardly at time $T_2$ and begins decreasing at time $T_3$ until the pressure P drops to the baseline pressure $P_B$ at time $T_4$. Thus, based on the sampled data, the microprocessor 200 determines that at time $T_4$, the pressure P has decreased by an amount that indicates a potential trailing edge 107 of a pressure pulse 100. The microprocessor 200 then begins an error analysis beginning at a predetermined time interval $T_W$ after the time $T_1$. The $T_W$ time interval represents the duration of an ideal pressure pulse 102 that is indicated by the signature data 202. Thus, for this example, the error analysis begins at time $T_1$, and the microprocessor 200 determines differences between the pulses 100 and 102 at different times from time $T_1$ to time $T_3$. As an example, the microprocessor 200 may calculate an error fit by squaring each difference; adding the squared differences together to form a sum; and taking the square root of the sum. The microprocessor 200 then compares the calculated number to a threshold to determine whether a pressure pulse 100 has been detected. Of course, other techniques may be used to derive an error fit between the pulse that is indicated by the signature data 202 and the detected pulse.

Figure 6:
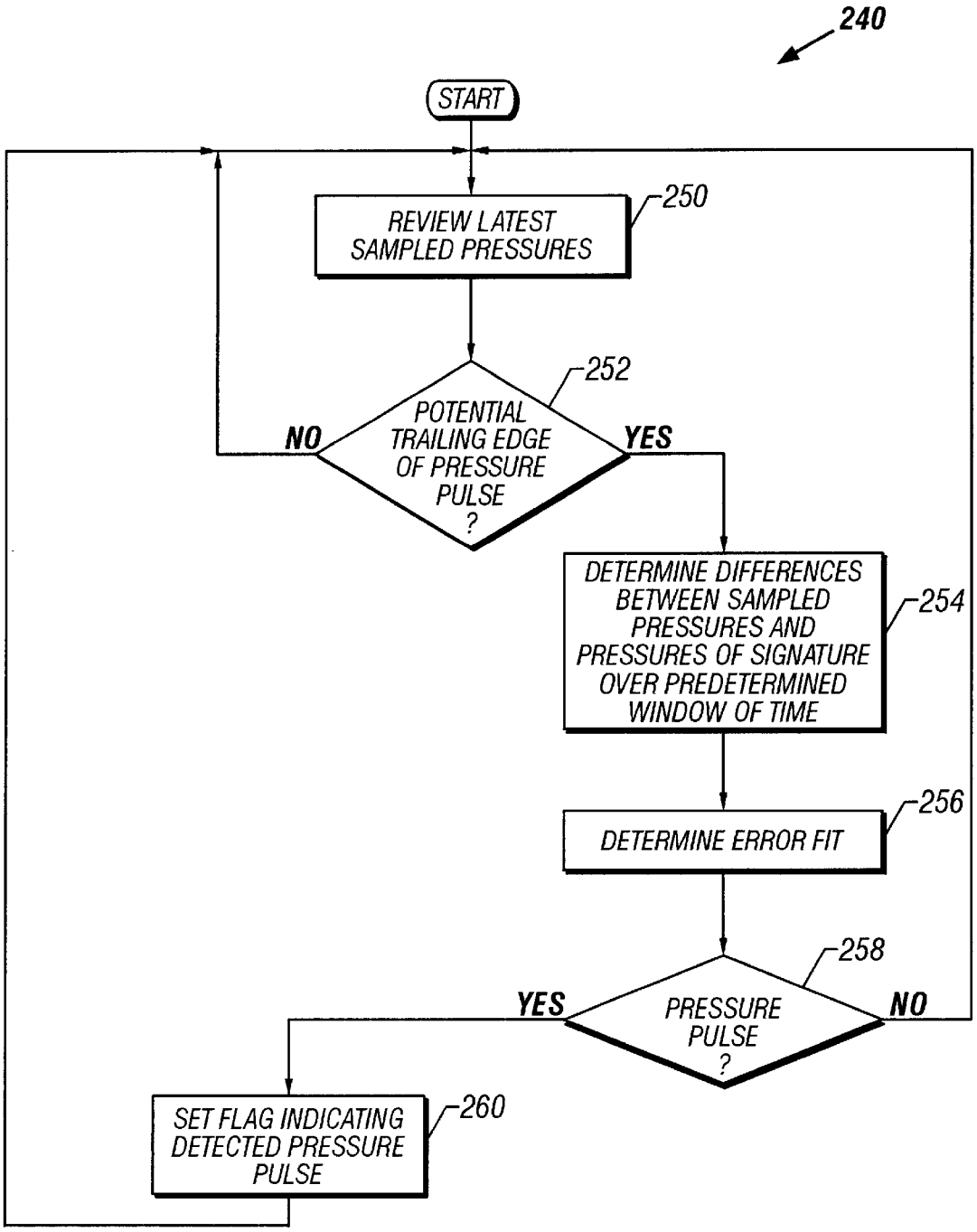
FIGS. 6 and 7 are flow diagrams depicting routines to verify a pressure pulse signature according to different embodiments of the invention.
Figure 7:
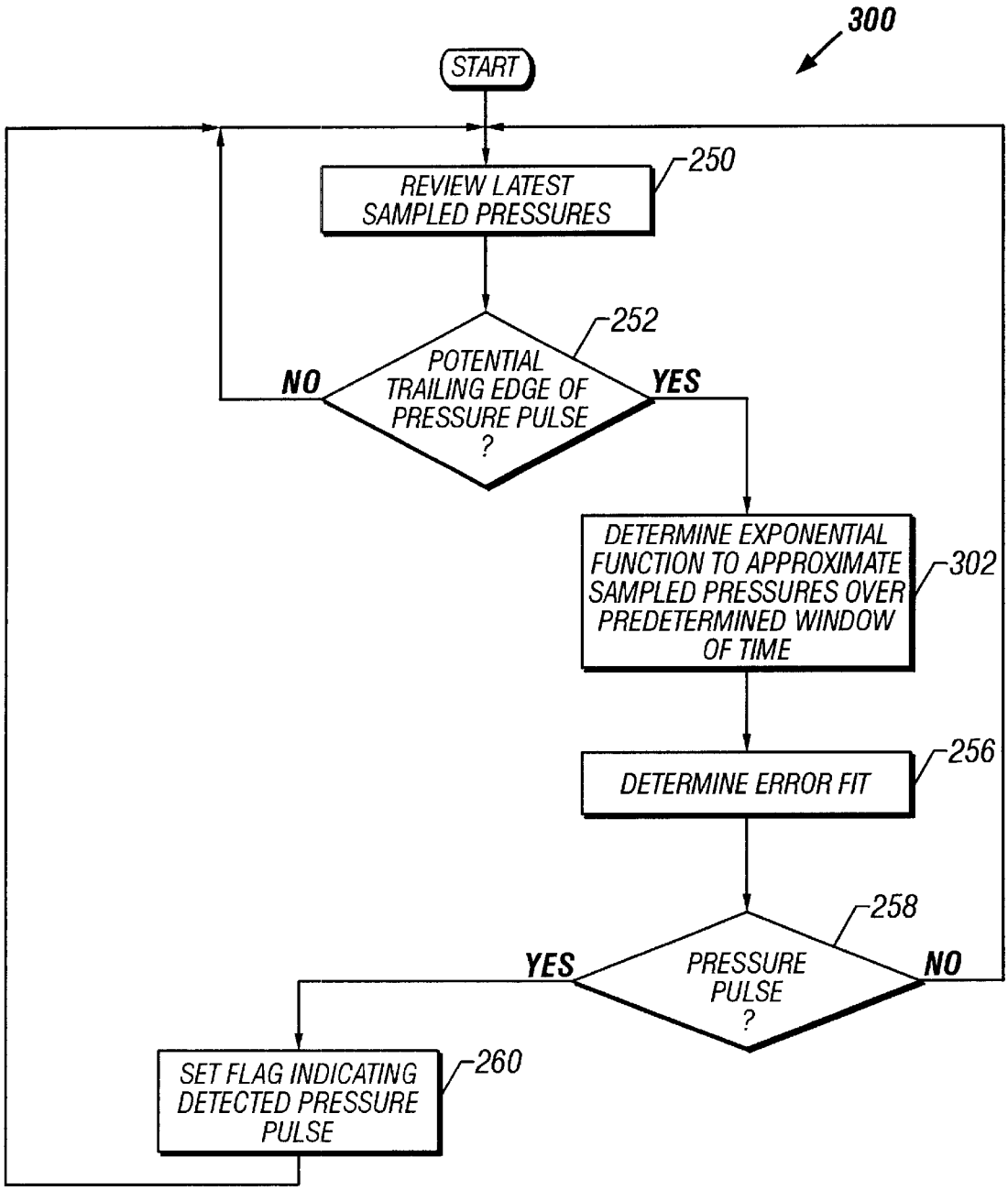

Other embodiments are within the scope of the following claims. For example, in some embodiments of the invention, the microprocessor 200 may perform a technique 300 that is depicted in FIG. 7 instead of performing the technique 240 that is depicted in FIG. 6. The technique 300 is similar to the technique 240 except that the technique 300 replaces block 254 with block 302. In this block 302, the microprocessor 200 determines an exponential function to approximate the sampled pressures on the rising edge of the pulse 100. In this manner, for the predetermined $T_W$ interval, the microprocessor 200 determines an exponential function that approximates the sampled pressures. The microprocessor 200 may perform this function by selecting the appropriate constants and time constants for the function to derive a "best fit," assuming that the sampled pressures do indicate a pressure pulse. Thus, in this embodiment, the microprocessor 200 does not use stored signature data 206. Instead, the microprocessor 200 determines an error fit (block 256) by comparing values of the calculated exponential function to the, sampled pressure values at corresponding times.

In the context of this application, the phrase "exponential function" generally describes a function that has an exponential component and may include a function that is subtracted from, added to or multiplied by constants.

Other embodiments of the invention are possible in which a portion of the pulse 100 may resemble function other than an exponential function. For example, in some embodiments of the invention, the pulse 100 may include linear or parabolic portions. However, regardless of the signature of the pulse 100, the detection techniques described here may be modified to detect a given pulse 100.

As an example of other embodiments of the invention, the pressure pulse may be a pressure drop to form a negative pressure pulse relative to some baseline pressure level. For example, the central passageway of the string 20 may be filled with a large amount of gas, such as Nitrogen, for example, that may displace or compress liquid and/or gas that is already present in the central passageway. As examples, the Nitrogen gas may be supplied by a tanker or a truck. Once pressurized to the desired level, the pressure may be vented from the central passageway to create the negative pressure pulses.

As yet another example of another embodiment of the invention, the annulus, instead of the central passageway, may be used to propagate the pressure pulses using the techniques that are described here. Other arrangements are possible.

While the invention has been disclosed with respect to a limited number of embodiments, those skilled in the art, having the benefit of this disclosure, will appreciate numerous modifications and variations therefrom. It is intended that the appended claims cover all such modifications and variations as fall within the true spirit and scope of the invention.

What is claimed is:

1. A system usable with a subterranean well, comprising:

a downhole assembly adapted to respond to a command encoded in a stimulus communicated downhole, wherein the stimulus has a first pressure signature and the downhole assembly is adapted to compare the first pressure signature to a second pressure signature to determine an error between the first and second pressure signatures and determine whether the first signature indicates the command based on the error; and an apparatus to change a pressure of a gas in communication with the well to generate at least part of the stimulus.

2. The system of claim 1, wherein the apparatus comprises:

at least one container of gas; and a valve adapted to selectively introduce gas from said at least one container into the well to generate at least part of the stimulus.

3. The system of claim 2, wherein said at least one container of gas comprises:

multiple bottles of gas.

4. The system of claim 2, wherein said at least one container of gas comprises multiple containers of gas, the system further comprising:

a manifold connected to the multiple containers of gas to combine gas from the multiple containers of gas to generate the stimulus.

5. The system of claim 4, wherein the manifold comprises at least one check valve to prevent flow of gas from the well into at least one of the containers.

6. The system of claim 4, wherein the manifold comprises at least one flow restrictor to regulate a flow, of gas from at least one of the containers into the well.

7. The system of claim 2, further comprising:

another valve to selectively release pressure from the well to generate the stimulus.

8. The system of claim 1, further comprising:

a tubular string extending from the surface of the well to the downhole assembly, the tubular string containing a gas layer and a liquid layer and the stimulus propagating through the gas and liquid layers.

9. The system of claim 1, further comprising:

a tubular string extending from the surface of the well to the downhole assembly, the tubular string containing a gas layer and the stimulus propagating through the gas layer.

10. The system of claim 1, wherein the stimulus comprises a predetermined pressure signature in at least one fluid layer of the well.

11. The system of claim 1, wherein the downhole assembly is adapted to decode the command from the stimulus.

12. The system of claim 1, wherein the downhole assembly performs an electrical function in response to the stimulus.

13. The system of claim 12, wherein the downhole assembly comprises a firing head.

14. The system of claim 1, wherein the downhole assembly performs a mechanical function in response to the stimulus.

15. The system of claim 14, wherein the downhole assembly comprises a packer.

16. The system of claim 14, wherein the downhole assembly comprises a valve.

17. The system of claim 1, wherein the gas comprises an inert gas.

18. The system of claim 1, wherein the gas comprises air.

19. The system of claim 1, wherein the gas comprises nitrogen.

20. The system of claim 1, further comprising:

a tubular string extending from the surface of the well to the downhole assembly, the tubular string forming an annulus containing a gas layer and a liquid layer and the stimulus propagating through the gas and liquid layers.

21. The system of claim 1; further comprising:

a tubular string extending from the surface of the well to the downhole assembly, the tubular string forming an annulus containing a gas layer and the stimulus propagating through the gas layer.

22. The system of claim 1, wherein an indication of the second pressure signature is stored in a memory of the downhole assembly.

23. The system of claim 22, wherein the indication is stored in the memory before the downhole assembly is run downhole.

24. The system of claim 22, wherein the indication is not stored in the memory in response to a downhole pressure measurement by the downhole assembly.

25. A method usable with a subterranean well, comprising:

establishing a gas layer above a downhole assembly located in the well;

selectively changing a pressure of the gas layer to generate a stimulus to propagate through the gas layer to the downhole assembly, the stimulus having a first pressure signature;

controlling the pressurizing of the gas layer to encode a command for the downhole assembly in the stimulus;

comparing the first pressure signature to a second pressure signature to determine an error between the first pressure signature and the second pressure signature; and determining whether the first pressure signature indicates the command based on the error.

26. The method of claim 25, further comprising:

providing a liquid layer above the downhole assembly, wherein the stimulus propagates through the liquid layer.

27. The method of claim 25, wherein the stimulus comprises a change in a pressure of the gas layer approximately less than or equal to 300 p.s.i.

28. The method of claim 25, wherein the act of selectively changing the pressure comprises:

selectively releasing gas from at least one gas container into the well.

29. The method of claim 25, wherein the act of selectively changing the pressure comprises:

selectively releasing gas from the well.

30. The method of claim 25, further comprising:

decoding the stimulus to extract the command; and performing an operation with the assembly in response to the decoding.

31. The method of claim 25, further comprising:

operating a mechanical apparatus in response to the stimulus.

32. The method of claim 25, further comprising:

operating an electrical apparatus in response to the stimulus.

33. The method of claim 25, further comprising:

firing a perforating gun in response to the stimulus.

34. The method of claim 25, further comprising:

setting a packer in response to the stimulus.

35. The method of claim 25, further comprising:

operating a valve in response to the stimulus.

36. The method of claim 25, wherein the gas layer is present in a tubular string of the well.

37. The method of claim 25, wherein the gas layer is present in an annulus of the well.

38. The method of claim 25, wherein the gas layer is present in a hose that extends to the well.

39. The method of claim 25, wherein the gas comprises an inert gas.

40. The method of claim 25, wherein the gas comprises air.

41. The method of claim 25, wherein the gas comprises nitrogen.

42. The method of claim 25, wherein the gas comprises natural gas.

43. The method of claim 25, further comprising:

supplying the gas from a tanker.

44. The method of claims 25, wherein an indication of the second pressure signature is stored in a memory of the downhole assembly.

45. The method of claim 44, wherein the indication is stored in the memory before the downhole assembly is run downhole.

46. The method of claim 44, wherein the indication is not stored in the memory in response to a downhole pressure measurement by the downhole assembly.

47. A method usable with a subterranean well, comprising:

receiving a stimulus downhole, the stimulus having a first pressure signature;

comparing the first pressure signature to a second pressure signature to determine an error between the first and second pressure signatures; and determining whether the first signature indicates a command based on the error.

48. The method of claim 47, further comprising:

determining a mathematical function to approximate at least a portion of the first pressure signature; and using the mathematical function to form at least part of the second pressure signature.

49. The method of claim 47, further comprising:

storing data indicative of pressures to define at least a portion of the second pressure signature.

50. The method of claims 47, further comprising:

detecting a characteristic of the first pressure signature; and performing the comparison of the first and second pressure signatures in response to the detection.

51. The method of claim 50, wherein the characteristic comprises a falling pressure level of the stimulus.

52. The method of claims 47, wherein the act of comparing comprises:

over a prior predetermined interval of time, determining differences between values associated with the first pressure signature and values associated with the second pressure signature; and determining the error based on the differences.

53. The method of claim 52, wherein the values associated with the first pressure signature comprise detected pressures.

54. The method of claim 52, further comprising:

storing indications of the values associated with the first pressure signature in a memory.

55. A downhole assembly usable with a subterranean well, comprising:

a sensor to receive a stimulus communicated downhole, the stimulus having a first pressure signature; and a controller coupled to the sensor and adapted to:

compare the first pressure signature to a second pressure signature to determine an error between the first pressure signature and the second pressure signature, and determine whether the first pressure signature indicates a command based on the error.

56. The downhole assembly of 55, wherein the controller is further adapted to:

determine a mathematical function to approximate at least a portion of the first pressure signature; and use the mathematical function to form at least part of the second pressure signature.

57. The downhole assembly of claim 55, wherein the controller is further adapted to:

detect a characteristic of the first pressure signature; and perform the comparison of the first pressure signature to the second pressure signature after the detection.

58. The downhole assembly of claim 57, wherein the characteristic comprises a falling pressure level of the stimulus.

59. The downhole assembly of claim 55, wherein the controller is adapted to compare by over a prior predetermined interval of time, determining differences between values associated with the first pressure signature and values associated with the second pressure signature; and determining the error based on the differences.

60. The downhole assembly of claim 59, wherein the values associated with the first pressure signature comprise detected pressures.

61. The downhole assembly of claim 59, further comprising:

a memory coupled to the controller to store indications of the values associated with the first pressure signature in a memory.

62. The downhole assembly of claim 59, further comprising:

a memory coupled to the controller to store indications of the values associated with the second pressure signature in a memory.

63. The downhole assembly of claim 59, wherein the controller is further adapted to:

operate a downhole tool in response to the determination of whether the first signature indicates a command.

64. The downhole assembly of claim 63, wherein the downhole tool comprises a packer.

65. The downhole assembly of claim 63, wherein the downhole tool comprises a firing head.

66. The downhole assembly of claim 63, wherein the downhole tool comprises a, valve.

67. The downhole assembly of claim 55, further comprising:

a memory storing an indication of the second pressure signature.

68. The downhole assembly of claim 67, wherein the indication is stored in the memory before the downhole assembly is run downhole.

69. The downhole assembly of claim 67, wherein the indication is not stored in the memory in response to a downhole pressure measurement by the downhole assembly.

* * * * *